US010660443B1

(12) United States Patent
Tsai

(10) Patent No.: US 10,660,443 B1
(45) Date of Patent: May 26, 2020

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVISION INC. (TW)

( * ) Notice: Subject to any disclaimer, the term of this patent is extended or adjusted under 35 U.S.C. 154(b) by 0 days.

(21) Appl. No.: 16/267,610

(22) Filed: Feb. 5, 2019

(30) Foreign Application Priority Data

Dec. 24, 2018 (TW) ..... 107146778 A

(51) Int. Cl.
*A47C 4/28* (2006.01)
*A47C 4/38* (2006.01)

(52) U.S. Cl.
CPC ..... *A47C 4/286* (2013.01); *A47C 4/38* (2013.01)

(58) Field of Classification Search
CPC ..... A47C 4/286; A47C 4/38
USPC ..... 297/16.2
See application file for complete search history.

(56) References Cited

U.S. PATENT DOCUMENTS 6,322,138 B1 * 11/2001 Tang ..... A47C 4/286 297/16.2
6,926,356 B2 * 8/2005 Chen ..... A47C 4/286 297/35
7,717,502 B2 * 5/2010 Deng ..... A47C 4/20 297/16.1
9,204,729 B2 * 12/2015 Frankel ..... A47C 1/14
10,206,510 B2 * 2/2019 Choi ..... A47C 4/286
10,455,941 B2 * 10/2019 Zhu ..... A47C 4/02

FOREIGN PATENT DOCUMENTS

CN 203416980 U 2/2014
CN 207707597 U 8/2018

* cited by examiner

*Primary Examiner* — Syed A Islam
(74) *Attorney, Agent, or Firm* — Schmeiser, Olsen & Watts, LLP

(57) ABSTRACT

A folding chair includes a left side folding mechanism, a right side folding mechanism, a front supporting mechanism, a rear supporting mechanism and a load-bearing structure. Therefore, not only can the folding chair be folded up like an umbrella and thus takes up little space and is portable, but the folding chair can also be unfolded and thus demonstrates high stability and high load-bearing capability.

10 Claims, 4 Drawing Sheets

FOLDING CHAIR

CROSS-REFERENCE TO RELATED APPLICATION

This non-provisional application claims priority under 35 U.S.C. § 119(a) on Patent Application No(s). 107146778 filed in Taiwan, R.O.C. on Dec. 24, 2018, the entire contents of which are hereby incorporated by reference.

FIELD OF THE INVENTION

The present disclosure relates to folding chairs and, more particularly, to a folding chair not only can be folded to store but can also be unfolded to use.

BACKGROUND OF THE INVENTION

A conventional folding chair consists of a frame, two legs, a pad and a back rest. The legs movably cross the frame. The pad movably fits to the frame. The back rest is mounted on the top of the frame. Therefore, the legs and the pad are unfolded on one side of the frame such that a sitter can sit on the pad. Alternatively, the legs and the pad can press against each other toward the frame, thereby allowing the folding chair to be folded.

However, the conventional folding chair has drawbacks described below. Folding the conventional folding chair involves pressing the legs and the pad against each other toward the frame; as a result, the width of the frame and the width of the pad remain unchanged, regardless of whether the conventional folding chair is folded or unfolded, and thus the conventional folding chair takes up much space and is not portable. Furthermore, after the folding chair has been unfolded, only the bottom of the frame and the legs are in contact with the ground to bear the weight of the folding chair, thereby compromising the stability and load-bearing capability of the folding chair.

Therefore, it is imperative to provide a folding chair which can be folded up like an umbrella and thus takes up little space and is portable and can be unfolded to demonstrate high stability and high load-bearing capability.

SUMMARY OF THE INVENTION

In view of the aforesaid drawbacks of the prior art, it is an objective of the present disclosure to provide a folding chair which can be folded up like an umbrella and thus takes up little space and is portable and can be unfolded to demonstrate high stability and high load-bearing capability.

In order to achieve the above and other objectives, the present disclosure provides a folding chair, comprising a left side folding mechanism, a right side folding mechanism, a front supporting mechanism, a rear supporting mechanism and a load-bearing structure. The left side folding mechanism comprises a left frame rod, a left frame connecting element, a left sliding element, a left limiting element, a left front leg rod, a left connecting rod, a left back rest rod, a left back rest sliding element and a left rear leg terminal, the left frame connecting element being movably disposed at the left frame rod, the left sliding element being movably, penetratingly disposed at the left frame rod, the left limiting element being disposed at the left frame rod and pressing against the left sliding element, wherein the middle of the left frame rod is movably coupled to the middle of the left front leg rod, the left connecting rod having two ends movably coupled to the left front leg rod and the left sliding element, respectively, the left back rest rod having one end movably coupled to the left sliding element, the left back rest sliding element being movably, penetratingly disposed at the left back rest rod, the left front leg rod having one end movably coupled to the left back rest sliding element, the left rear leg terminal being movably coupled to another end of the left frame rod; the right side folding mechanism is opposite the left side folding mechanism, the right side folding mechanism comprising a right frame rod, a right frame connecting element, a right sliding element, a right limiting element, a right front leg rod, a right connecting rod, a right back rest rod, a right back rest sliding element and a right rear leg terminal, the right frame connecting element being movably disposed at the right frame rod, the right sliding element being movably, penetratingly disposed at the right frame rod, the right limiting element being disposed at the right frame rod and pressing against the right sliding element, wherein the middle of the right frame rod is movably coupled to the middle of the right front leg rod, the right connecting rod having two ends movably coupled to the right front leg rod and the right sliding element, respectively, the right back rest rod having one end movably coupled to the right sliding element, the right back rest sliding element being movably, penetratingly disposed at the right back rest rod, the right front leg rod having one end movably coupled to the right back rest sliding element, the right rear leg terminal being movably coupled to another end of the right frame rod; the front supporting mechanism is disposed between the left side folding mechanism and the right side folding mechanism, the front supporting mechanism comprising a first front supporting rod and a second front supporting rod, wherein the first front supporting rod and the second front supporting rod cross each other and are movably coupled together, the first front supporting rod being movably coupled to the left frame connecting element, the first front supporting rod having one end movably coupled to the right front leg rod, with a first bend segment disposed at another end of the first front supporting rod, the second front supporting rod being movably coupled to the right frame connecting element, the second front supporting rod having one end movably coupled to the left front leg rod, with a second bend segment disposed at another end of the second front supporting rod; wherein the rear supporting mechanism is disposed between the left side folding mechanism and the right side folding mechanism, the rear supporting mechanism comprising a first rear supporting rod and a second rear supporting rod, wherein the first rear supporting rod and the second rear supporting rod cross each other and are movably coupled together, the first rear supporting rod having two ends movably coupled to the left back rest sliding element and the right rear leg terminal, respectively, the second rear supporting rod having two ends movably coupled to the right back rest sliding element and the left rear leg terminal, respectively; wherein the load-bearing structure is disposed at the left side folding mechanism, the right side folding mechanism, the first bend segment and the second bend segment.

In an embodiment of the folding chair, the left frame connecting element has a first fitting portion and a first pivotal connection portion, the first pivotal connection portion being disposed on one side of the first fitting portion, the left frame rod being movably coupled to the first fitting portion, the first front supporting rod being movably coupled to the first pivotal connection portion.

In an embodiment of the folding chair, the left sliding element has a second fitting portion, a second pivotal connection portion and a third pivotal connection portion, the second pivotal connection portion being disposed at one end of the second fitting portion, the third pivotal connection portion being disposed at another end of the second fitting portion and spaced apart from the second pivotal connection portion, the left frame rod being movably, penetratingly disposed at the second fitting portion, the left limiting element pressing against the second fitting portion, the left connecting rod having one end movably coupled to the second pivotal connection portion, the left back rest rod having one end movably coupled to the third pivotal connection portion.

In an embodiment of the folding chair, the left back rest sliding element has a third fitting portion, a fourth pivotal connection portion and a fifth pivotal connection portion, the fourth pivotal connection portion being disposed at one end of the third fitting portion, the fifth pivotal connection portion being disposed on one side of the third fitting portion, the left back rest rod being movably, penetratingly disposed at the third fitting portion, the left front leg rod having one end movably coupled to the fourth pivotal connection portion, the first rear supporting rod having one end movably coupled to the fifth pivotal connection portion.

In an embodiment of the folding chair, a left front leg terminal is disposed at another end of the left front leg rod.

In an embodiment of the folding chair, the right frame connecting element has a fourth fitting portion and a sixth pivotal connection portion, the sixth pivotal connection portion being disposed on one side of the fourth fitting portion, the right frame rod being movably coupled to the fourth fitting portion, the second front supporting rod being movably coupled to the sixth pivotal connection portion.

In an embodiment of the folding chair, the right sliding element has a fifth fitting portion, a seventh pivotal connection portion and an eighth pivotal connection portion, the seventh pivotal connection portion being disposed at one end of the fifth fitting portion, the eighth pivotal connection portion being disposed at another end of the fifth fitting portion and spaced apart from the seventh pivotal connection portion, the right frame rod being movably, penetratingly disposed at the fifth fitting portion, the right limiting element pressing against the fifth fitting portion, the right connecting rod having one end movably coupled to the seventh pivotal connection portion, the right back rest rod having one end movably coupled to the eighth pivotal connection portion.

In an embodiment of the folding chair, the right back rest sliding element has a sixth fitting portion, a ninth pivotal connection portion and a tenth pivotal connection portion, the ninth pivotal connection portion being disposed at one end of the sixth fitting portion, the tenth pivotal connection portion being disposed on one side of the sixth fitting portion, the right back rest rod being movably, penetratingly disposed at the sixth fitting portion, the right front leg rod having one end movably coupled to the ninth pivotal connection portion, the second rear supporting rod having one end movably coupled to the tenth pivotal connection portion.

In an embodiment of the folding chair, a right front leg terminal is disposed at another end of the right front leg rod.

In an embodiment of the folding chair, the load-bearing structure comprises a sitting portion, a back rest portion, a left handrail portion and a right handrail portion, the sitting portion being disposed at the left frame rod and the right frame rod, the back rest portion being disposed at the left back rest rod and the right back rest rod, the back rest portion being connected to the sitting portion, the left handrail portion having two ends disposed at the left back rest rod and the first bend segment, respectively, the right handrail portion having two ends disposed at the right back rest rod and the second bend segment, respectively.

Therefore, the folding chair of the present disclosure can be folded up like an umbrella and thus takes up little space and is portable and can be unfolded to demonstrate high stability and high load-bearing capability.

DETAILED DESCRIPTION OF THE PREFERRED EMBODIMENTS

Figure 1:
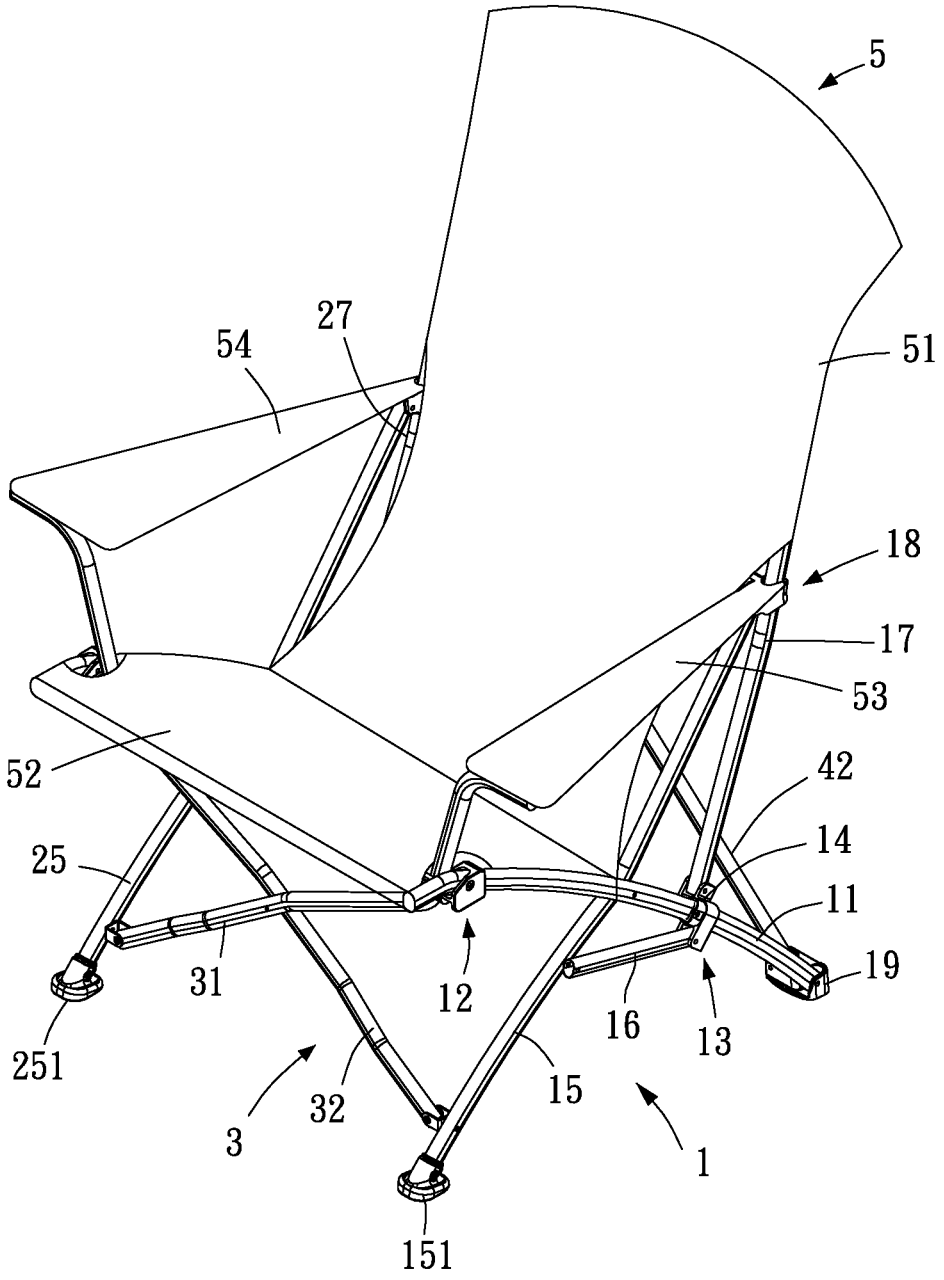
FIG. 1 of a schematic view of a folding chair unfolded according to the present disclosure.

Objectives, features, and advantages of the present disclosure are hereunder illustrated with specific embodiments, depicted with drawings, and described below.

Referring to FIG. 1 through FIG. 4, the present disclosure provides a folding chair comprising a left side folding mechanism 1, a right side folding mechanism 2, a front supporting mechanism 3, a rear supporting mechanism 4 and a load-bearing structure 5.

The left side folding mechanism 1 comprises a left frame rod 11, a left frame connecting element 12, a left sliding element 13, a left limiting element 14, a left front leg rod 15, a left connecting rod 16, a left back rest rod 17, a left back rest sliding element 18 and a left rear leg terminal 19. The left frame connecting element 12 is movably disposed at one end of the left frame rod 11. The left sliding element 13 is movably, penetratingly disposed at the left frame rod 11. The left limiting element 14 is disposed at the left frame rod 11 and presses against the left sliding element 13. The middle of the left frame rod 11 is movably coupled to the middle of the left front leg rod 15. The left connecting rod 16 has two ends movably coupled to the left front leg rod 15 and the left sliding element 13, respectively. The left back rest rod 17 has one end movably coupled to the left sliding element 13. The left back rest sliding element 18 is movably, penetratingly disposed at the left back rest rod 17. The left front leg rod 15 has one end movably coupled to the left back rest sliding element 18. The left rear leg terminal 19 is movably coupled to the other end of the left frame rod 11.

The right side folding mechanism 2 is opposite the left side folding mechanism 1. The right side folding mechanism 2 comprises a right frame rod 21, a right frame connecting element 22, a right sliding element 23, a right limiting element 24, a right front leg rod 25, a right connecting rod 26, a right back rest rod 27, a right back rest sliding element 28 and a right rear leg terminal 29. The right frame connecting element 22 is movably disposed at one end of the right frame rod 21. The right sliding element 23 is movably, penetratingly disposed at the right frame rod 21. The right limiting element 24 is disposed at the right frame rod 21 and presses against the right sliding element 23. The middle of the right frame rod 21 is movably coupled to the middle of the right front leg rod 25. The right connecting rod 26 has two ends movably coupled to the right front leg rod 25 and the right sliding element 23, respectively. The right back rest rod 27 has one end movably coupled to the right sliding element 23. The right back rest sliding element 28 is movably, penetratingly disposed at the right back rest rod 27. The right front leg rod 25 has one end movably coupled to the right back rest sliding element 28. The right rear leg terminal 29 is movably coupled to one end of the right frame rod 21.

The front supporting mechanism 3 is disposed between the left side folding mechanism 1 and the right side folding mechanism 1. The front supporting mechanism 3 comprises a first front supporting rod 31 and a second front supporting rod 32. The first front supporting rod 31 and the second front supporting rod 32 cross each other and are movably coupled together. The first front supporting rod 31 is movably coupled to the left frame connecting element 12. One end of the first front supporting rod 31 is movably coupled to the right front leg rod 25. A first bend segment 311 is disposed at the other end of the first front supporting rod 31. The second front supporting rod 32 is movably coupled to the right frame connecting element 22. One end of the second front supporting rod 32 is movably coupled to the left front leg rod 15. A second bend segment 321 is disposed at the other end of the second front supporting rod 32.

The rear supporting mechanism 4 is disposed between the left side folding mechanism 1 and the right side folding mechanism 2. The rear supporting mechanism 4 comprises a first rear supporting rod 41 and a second rear supporting rod 42. The first rear supporting rod 41 and the second rear supporting rod 42 cross each other and are movably coupled together. The first rear supporting rod 41 has two ends movably coupled to the left back rest sliding element 18 and the right rear leg terminal 29, respectively. The second rear supporting rod 42 has two ends movably coupled to the right back rest sliding element 28 and the left rear leg terminal 19, respectively.

The load-bearing structure 5 is disposed at the left side folding mechanism 1, the right side folding mechanism 2, the first bend segment 311 and the second bend segment 321. The load-bearing structure 5 is made of a soft material, such as fabric or plastic.

Figure 2:
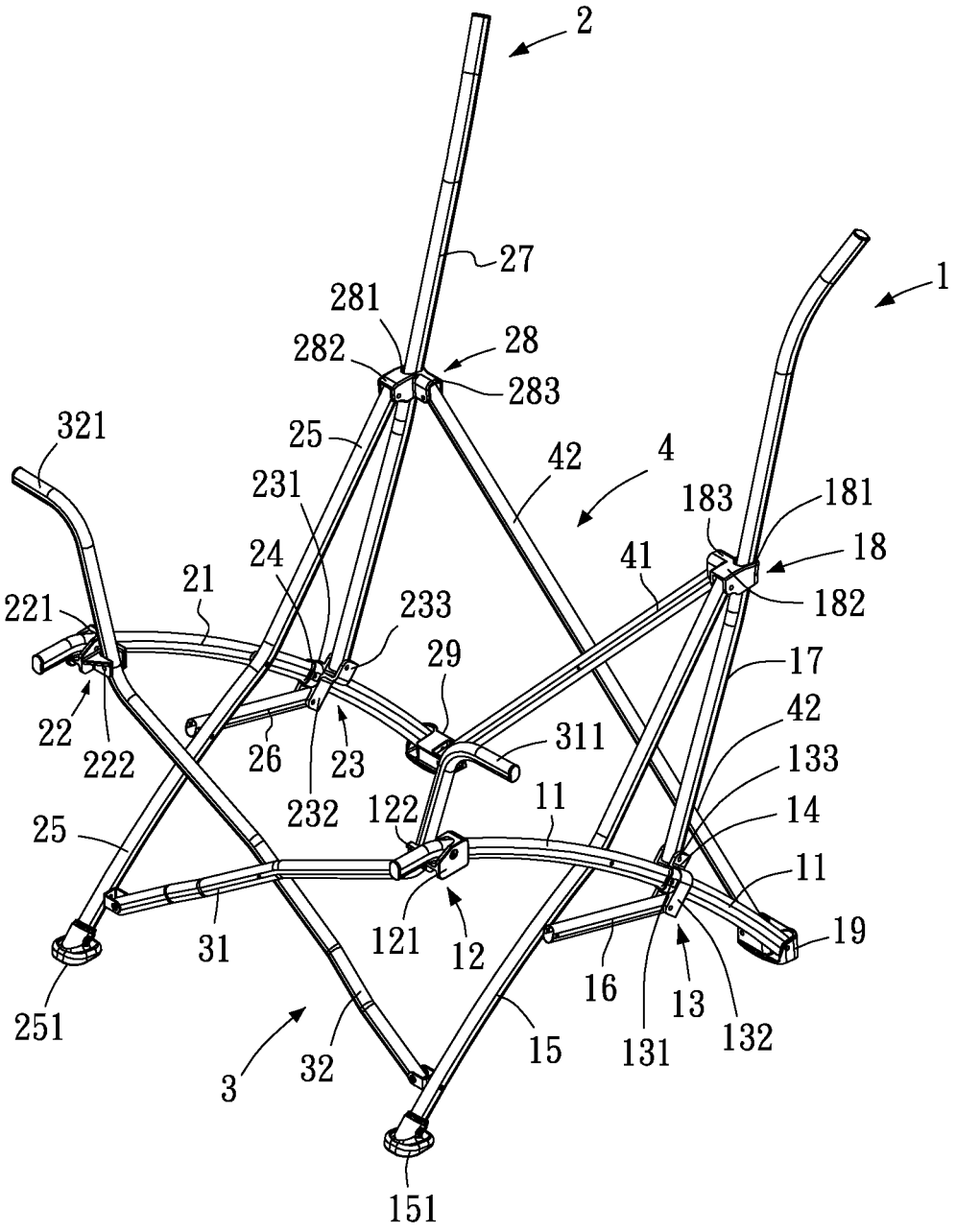
FIG. 2 of a schematic view of the folding chair unfolded without any load-bearing structure according to the present disclosure.
Figure 3:
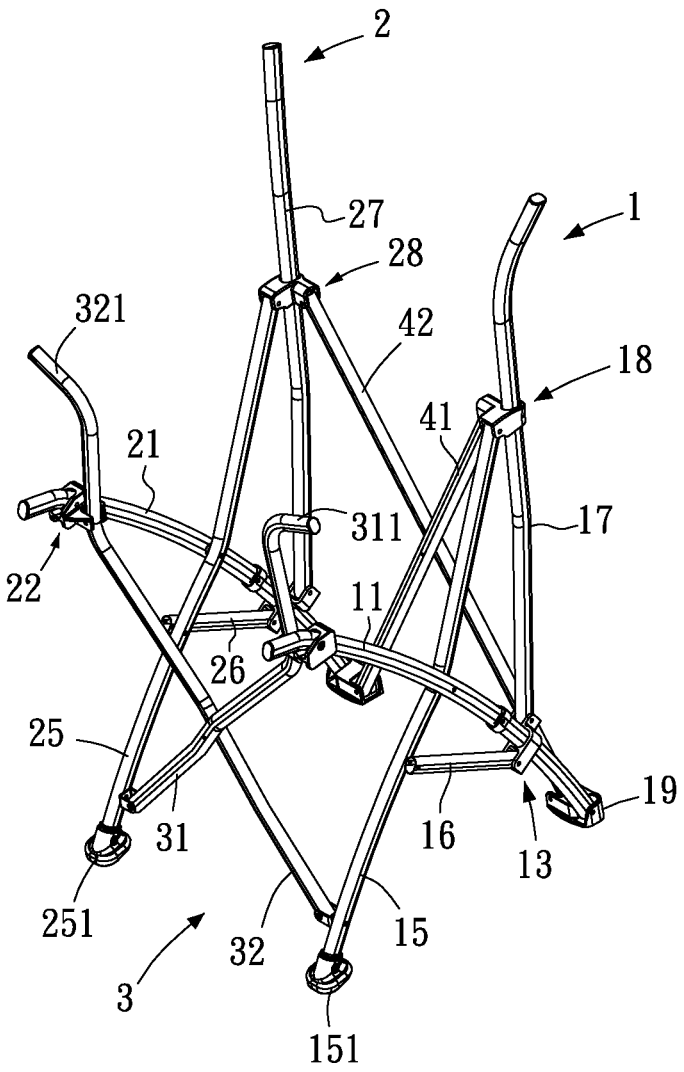
FIG. 3 is a schematic view 1 of the folding chair folded without any load-bearing structure according to the present disclosure.
Figure 4:
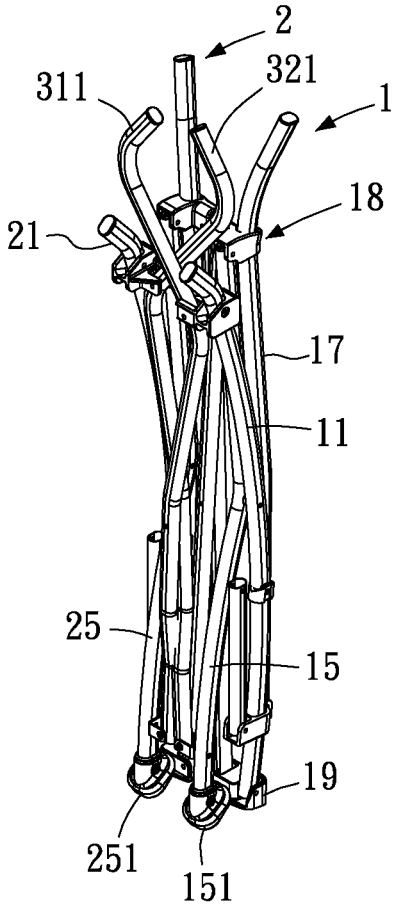
FIG. 4 is a schematic view 2 of the folding chair folded without any load-bearing structure according to the present disclosure.

As shown in FIG. 2 through FIG. 4, to fold the folding chair, the user grips one end of the left back rest rod 17 (or the right back rest rod 27) and one end of the left frame rod 11 (or the right frame rod 21) simultaneously and then pushes the left frame rod 11 above the left rear leg terminal 19 toward the left back rest rod 17 such that both the left frame rod 11 and the left front leg rod 15 move toward the left back rest rod 17, and the left frame connecting element 12 drives the first front supporting rod 31 toward the left back rest rod 17; meanwhile, the left back rest sliding element 18 slides upward and drives the first rear supporting rod 41 toward the left back rest rod 17, and the left connecting rod 16 pushes and causes the left sliding element 13 to slide downward. While the left side folding mechanism 1 is operating in a manner described above, the right side folding mechanism 2 causes the right frame rod 21 to move above the right rear leg terminal 29 toward the right back rest rod 27 such that the right frame rod 21 and the right front leg rod 25 move simultaneously toward the right back rest rod 27, and the right frame connecting element 22 drives the second front supporting rod 32 toward the right back rest rod 27; meanwhile, the right back rest sliding element 28 slides upward and causes the second rear supporting rod 42 to move toward the right back rest rod 27, and the right connecting rod 26 causes the right sliding element 23 to slide downward. Therefore, the folding chair can be folded up like an umbrella and thus takes up little space and is portable.

In an embodiment of the present disclosure, as shown in FIG. 2 through FIG. 4, the left frame connecting element 12 has a first fitting portion 121 and a first pivotal connection portion 122. The first pivotal connection portion 122 is disposed on one side of the first fitting portion 121. The left frame rod 11 is movably coupled to the first fitting portion 121. The first front supporting rod 31 is movably coupled to the first pivotal connection portion 122. Therefore, when the left frame rod 11 moves, the first pivotal connection portion 122 of the left frame connecting element 12 causes the first front supporting rod 31 to move; hence, not only can the left frame rod 11 drive the first front supporting rod 31 easily, but both the left frame rod 11 and the first front supporting rod 31 also demonstrate high stability and high load-bearing capability when the folding chair has been unfolded.

In an embodiment of the present disclosure, as shown in FIG. 2 through FIG. 4, the left sliding element 13 has a second fitting portion 131, a second pivotal connection portion 132 and a third pivotal connection portion 133. The second pivotal connection portion 132 is disposed at one end of the second fitting portion 131. The third pivotal connection portion 133 is disposed at the other end of the second fitting portion 131 and spaced apart from the second pivotal connection portion 132. The left frame rod 11 is movably, penetratingly disposed at the second fitting portion 131. When the folding chair of the present disclosure is unfolded, the left limiting element 14 presses against the second fitting portion 131 such that the left connecting rod 16 has one end movably coupled to the second pivotal connection portion 132, and the left back rest rod 17 has one end movably coupled to the third pivotal connection portion 133. Therefore, regardless of whether the folding chair of the present disclosure is folded or unfolded, the left connecting rod 16 exerts a force to thereby move the second pivotal connection portion 132 such that the left sliding element 13 slides downward or upward along the left frame rod 11 because of the second fitting portion 131. Therefore, given the third pivotal connection portion 133, the left frame rod 11 moves toward the left back rest rod 17 or away from the left back rest rod 17. Therefore, not only does the left sliding element 13 move smoothly, but the left frame rod 11, the left connecting rod 16 and the left back rest rod 17 also demonstrate high stability and high load-bearing capability after the folding chair has been unfolded.

In an embodiment of the present disclosure, as shown in FIG. 2 through FIG. 4, the left back rest sliding element 18 has a third fitting portion 181, a fourth pivotal connection portion 182 and a fifth pivotal connection portion 183. The fourth pivotal connection portion 182 is disposed at one end of the third fitting portion 181. The fifth pivotal connection portion 183 is disposed on one side of the third fitting portion 181. The left back rest rod 17 is movably, penetratingly disposed at the third fitting portion 181. The left front leg rod 15 has one end movably coupled to the fourth pivotal connection portion 182. The first rear supporting rod 41 has one end movably coupled to the fifth pivotal connection portion 183. Therefore, when the folding chair of the present disclosure is folded or unfolded, the left front leg rod 15 moves toward or away from the left back rest rod 17 because of the fourth pivotal connection portion 182. The third fitting portion 181 causes the left back rest sliding element 18 to slide downward or upward along the left back rest rod 17 and drives, in conjunction with the fifth pivotal connection portion 183, the first rear supporting rod 41 toward or away from the left back rest rod 17. Therefore, not only does the left back rest sliding element 18 move smoothly, the left front leg rod 15, the left back rest rod 17 and the first rear supporting rod 41 also demonstrate high stability and high load-bearing capability after the folding chair of the present disclosure has been unfolded.

In an embodiment of the present disclosure, as shown in FIG. 2 through FIG. 4, a left front leg terminal 151 is disposed at the other end of the left front leg rod 15. Therefore, when the folding chair of the present disclosure is folded or unfolded, the left front leg terminal 151 and the left rear leg terminal 19 operate in conjunction with each other to provide protection to the left frame rod 11 and the left front leg rod 15, so as to not only prevent the left frame rod 11 and the left front leg rod 15 from coming into direct contact with the ground and thus causing damage, but also achieve ant-sliding effect, thereby allowing the left side folding mechanism 1 to demonstrate high stability and high load-bearing capability.

In an embodiment of the present disclosure, as shown in FIG. 2 through FIG. 4, the right frame connecting element 22 has a fourth fitting portion 221 and a sixth pivotal connection portion 222. The sixth pivotal connection portion 222 is disposed on one side of the fourth fitting portion 221. The right frame rod 21 is movably coupled to the fourth fitting portion 221. The second front supporting rod 32 is movably coupled to the sixth pivotal connection portion 222. Therefore, while the right frame rod 21 is moving, the sixth pivotal connection portion 222 of the right frame connecting element 22 drives the second front supporting rod 32 to move to thereby not only allow the right frame rod 11 to easily move the second front supporting rod 31, but also allow the right frame rod 11 and the second front supporting rod 32 to demonstrate high stability and high load-bearing capability when the folding chair has been unfolded.

In an embodiment of the present disclosure, as shown in FIG. 2 through FIG. 4, the right sliding element 23 has a fifth fitting portion 231, a seventh pivotal connection portion 232 and an eighth pivotal connection portion 233. The seventh pivotal connection portion 232 is disposed at one end of the fifth fitting portion 231. The eighth pivotal connection portion 233 is disposed at the other end of the fifth fitting portion 231 and spaced apart from the seventh pivotal connection portion 232. The right frame rod 21 is movably, penetratingly disposed at the fifth fitting portion 231. As soon as the folding chair of the present disclosure is unfolded, the right limiting element 24 presses against the fifth fitting portion 231. The right connecting rod 26 has one end movably coupled to the seventh pivotal connection portion 232. The right back rest rod 27 has one end movably coupled to the eighth pivotal connection portion 233. Therefore, when the folding chair of the present disclosure is folded or unfolded, the right connecting rod 26 exerts a force to push the seventh pivotal connection portion 232 such that the right sliding element 23 slides downward or upward along the right frame rod 21 because of the fifth fitting portion 231; hence, given the eighth pivotal connection portion 233, the right frame rod 21 moves toward or away from the right back rest rod 27. Therefore, not only does the right sliding element 23 move smoothly, but the right frame rod 21, the right connecting rod 26 and the right back rest rod 27 also demonstrate high stability and high load-bearing capability after the folding chair of the present disclosure has been unfolded.

In an embodiment of the present disclosure, as shown in FIG. 2 through FIG. 4, the right back rest sliding element 28 has a sixth fitting portion 281, a ninth pivotal connection portion 282 and a tenth pivotal connection portion 283. The ninth pivotal connection portion 282 is disposed at one end of the sixth fitting portion 281. The tenth pivotal connection portion 283 is disposed on one side of the sixth fitting portion 281. The right back rest rod 27 is movably, penetratingly disposed at the sixth fitting portion 281. The right front leg rod 25 has one end movably coupled to the ninth pivotal connection portion 282. The second rear supporting rod 42 has one end movably coupled to the tenth pivotal connection portion 283. Therefore, when the folding chair of the present disclosure is folded or unfolded, the right front leg rod 25 moves toward or away from the right back rest rod 27 right back rest rod 17 because of the ninth pivotal connection portion 282. Owing to the sixth fitting portion 281, the right back rest sliding element 28 slides downward or upward along the right back rest rod 27 and drives, in conjunction with the tenth pivotal connection portion 283, the second rear supporting rod 42 toward or away from the right back rest rod 27. Therefore, not only does the right back rest sliding element 28 move smoothly, but the right front leg rod 25, the right back rest rod 27 and the second rear supporting rod 42 also demonstrate high stability and high load-bearing capability after the folding chair of the present disclosure has been unfolded.

In an embodiment of the present disclosure, as shown in FIG. 2 through FIG. 4, a right front leg terminal 251 is disposed at the other end of the right front leg rod 25. Therefore, when the folding chair of the present disclosure is folded or unfolded, the right front leg terminal 251 and the right rear leg terminal 29 operate in conjunction with each other to provide protection to the right frame rod 21 and the right front leg rod 25, so as to not only prevent the right frame rod 21 and the right front leg rod 25 from coming into direct contact with the ground and thus causing damage, but also achieve anti-sliding effect, thereby allowing the right side folding mechanism 2 to demonstrate high stability and high load-bearing capability.

In an embodiment of the present disclosure, as shown in FIG. 1, the load-bearing structure 5 comprises a sifting portion 51, a back rest portion 52, a left handrail portion 53 and a right handrail portion 54. The sitting portion 51 is disposed at the left frame rod 11 and the right frame rod 21. The back rest portion 52 is disposed at the left back rest rod 17 and the right back rest rod 27. The back rest portion 52 is connected to the sitting portion 51. The left handrail portion 53 has two ends disposed at the left back rest rod 17 and the first bend segment 311, respectively. The right handrail portion 54 has two ends disposed at the right back rest rod 27 and the second bend segment 321, respectively. Therefore, a sitter can sit at the sifting portion 51, with the sitter's back pressing against the back rest portion 52 and both hands gripping the left handrail portion 53 and the right handrail portion 54, respectively, to thereby enhance the sitter's comfort.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A folding chair, comprising:

a left side folding mechanism comprising a left frame rod, a left frame connecting element, a left sliding element, a left limiting element, a left front leg rod, a left connecting rod, a left back rest rod, a left back rest sliding element and a left rear leg terminal, the left frame connecting element being movably disposed at one end of the left frame rod, the left sliding element being movably, penetratingly disposed at the left frame rod, the left limiting element being disposed at the left frame rod and pressing against the left sliding element, wherein a middle of the left frame rod is movably coupled to a middle of the left front leg rod, the left connecting rod having two ends movably coupled to the left front leg rod and the left sliding element, respectively, the left back rest rod having one end movably coupled to the left sliding element, the left back rest sliding element being movably, penetratingly disposed at the left back rest rod, the left front leg rod having one end movably coupled to the left back rest sliding element, and the left rear leg terminal being movably coupled to another end of the left frame rod;

a right side folding mechanism disposed on one side of the left side folding mechanism and comprising a right frame rod, a right frame connecting element, a right sliding element, a right limiting element, a right front leg rod, a right connecting rod, a right back rest rod, a right back rest sliding element and a right rear leg terminal, the right frame connecting element being movably disposed at one end of the right frame rod, the right sliding element being movably, penetratingly disposed at the right frame rod, the right limiting element being disposed at the right frame rod and pressing against the right sliding element, wherein a middle of the right frame rod is movably coupled to a middle of the right front leg rod, the right connecting rod having two ends movably coupled to the right front leg rod and the right sliding element, respectively, the right back rest rod having one end movably coupled to the right sliding element, the right back rest sliding element being movably, penetratingly disposed at the right back rest rod, the right front leg rod having one end movably coupled to the right back rest sliding element, the right rear leg terminal being movably coupled to another end of the right frame rod;

a front supporting mechanism disposed between the left side folding mechanism and the right side folding mechanism and comprising a first front supporting rod and a second front supporting rod, wherein the first front supporting rod and the second front supporting rod cross each other and are movably coupled together, the first front supporting rod being movably coupled to the left frame connecting element, the first front supporting rod having one end movably coupled to the right front leg rod, with a first bend segment disposed at another end of the first front supporting rod, such that the second front supporting rod is movably coupled to the right frame connecting element, the second front supporting rod having one end movably coupled to the left front leg rod, with a second bend segment disposed at another end of the second front supporting rod;

a rear supporting mechanism disposed between the left side folding mechanism and the right side folding mechanism and comprising a first rear supporting rod and a second rear supporting rod, wherein the first rear supporting rod and the second rear supporting rod cross each other and are movably coupled together, the first rear supporting rod having two ends movably coupled to the left back rest sliding element and the right rear leg terminal, respectively, the second rear supporting rod having two ends movably coupled to the right back rest sliding element and the left rear leg terminal, respectively; and a load-bearing structure disposed at the left side folding mechanism, the right side folding mechanism, the first bend segment and the second bend segment.

2. The folding chair of claim 1, wherein the left frame connecting element has a first fitting portion and a first pivotal connection portion, the first pivotal connection portion being disposed on one side of the first fitting portion, the left frame rod being movably coupled to the first fitting portion, the first front supporting rod being movably coupled to the first pivotal connection portion.

3. The folding chair of claim 1, wherein the left sliding element has a second fitting portion, a second pivotal connection portion and a third pivotal connection portion, the second pivotal connection portion being disposed at one end of the second fitting portion, the third pivotal connection portion being disposed at another end of the second fitting portion and spaced apart from the second pivotal connection portion, the left frame rod being movably, penetratingly disposed at the second fitting portion, the left limiting element pressing against the second fitting portion, the left connecting rod having one end movably coupled to the second pivotal connection portion, the left back rest rod having one end movably coupled to the third pivotal connection portion.

4. The folding chair of claim 1, wherein the left back rest sliding element has a third fitting portion, a fourth pivotal connection portion and a fifth pivotal connection portion, the fourth pivotal connection portion being disposed at one end of the third fitting portion, the fifth pivotal connection portion being disposed on one side of the third fitting portion, the left back rest rod being movably, penetratingly disposed at the third fitting portion, the left front leg rod having one end movably coupled to the fourth pivotal connection portion, the first rear supporting rod having one end movably coupled to the fifth pivotal connection portion.

5. The folding chair of claim 1, wherein a left front leg terminal is disposed at another end of the left front leg rod.

6. The folding chair of claim 1, wherein the right frame connecting element has a fourth fitting portion and a sixth pivotal connection portion, the sixth pivotal connection portion being disposed on one side of the fourth fitting portion, the right frame rod being movably coupled to the fourth fitting portion, the second front supporting rod being movably coupled to the sixth pivotal connection portion.

7. The folding chair of claim 1, wherein the right sliding element has a fifth fitting portion, a seventh pivotal connection portion and an eighth pivotal connection portion, the seventh pivotal connection portion being disposed at one end of the fifth fitting portion, the eighth pivotal connection portion being disposed at another end of the fifth fitting portion and spaced apart from the seventh pivotal connection portion, the right frame rod being movably, penetratingly disposed at the fifth fitting portion, the right limiting element pressing against the fifth fitting portion, the right connecting rod having one end movably coupled to the seventh pivotal connection portion, the right back rest rod having one end movably coupled to the eighth pivotal connection portion.

8. The folding chair of claim 1, wherein the right back rest sliding element has a sixth fitting portion, a ninth pivotal connection portion and a tenth pivotal connection portion, the ninth pivotal connection portion being disposed at one end of the sixth fitting portion, the tenth pivotal connection portion being disposed on one side of the sixth fitting portion, the right back rest rod being movably, penetratingly disposed at the sixth fitting portion, the right front leg rod having one end movably coupled to the ninth pivotal connection portion, the second rear supporting rod having one end movably coupled to the tenth pivotal connection portion.

9. The folding chair of claim 1, wherein a right front leg terminal is disposed at another end of the right front leg rod.

10. The folding chair of claim 1, wherein the load-bearing structure comprises a sitting portion, a back rest portion, a left handrail portion and a right handrail portion, the sitting portion being disposed at the left frame rod and the right frame rod, the back rest portion being disposed at the left back rest rod and the right back rest rod, the back rest portion being connected to the sitting portion, the left handrail portion having two ends disposed at the left back rest rod and the first bend segment, respectively, the right handrail portion having two ends disposed at the right back rest rod and the second bend segment, respectively.

* * * * *